US008312799B2

(12) United States Patent
Frolov

(10) Patent No.: US 8,312,799 B2
(45) Date of Patent: Nov. 20, 2012

(54) RIP FENCE WITH A ROLLER-TYPE ACTIVATION MECHANISM

(75) Inventor: Andrew Frolov, Glenview, IL (US)

(73) Assignee: Robert Bosch GmbH, Stuttgart (DE)

( * ) Notice: Subject to any disclaimer, the term of this patent is extended or adjusted under 35 U.S.C. 154(b) by 280 days.

(21) Appl. No.: 12/551,022

(22) Filed: Aug. 31, 2009

(65) Prior Publication Data

US 2011/0048201 A1 Mar. 3, 2011

(51) Int. Cl.
*B26D 7/01* (2006.01)

(52) U.S. Cl. ..... 83/438; 83/468.7; 83/477.2; 144/287

(58) Field of Classification Search ..... 83/446, 83/438, 468.4, 468.7, 477.2; 144/287
See application file for complete search history.

(56) References Cited

U.S. PATENT DOCUMENTS

| | | | | |
|---|---|---|---|---|
| 2,677,400 | A * | 5/1954 | Gaskell | 83/438 |
| 2,740,437 | A * | 4/1956 | Odlum et al. | 83/438 |
| 3,011,531 | A | 12/1961 | Gaskell | |
| 4,206,910 | A * | 6/1980 | Biesemeyer | 269/236 |
| 4,658,687 | A * | 4/1987 | Haas et al. | 83/438 |
| 5,181,446 | A * | 1/1993 | Theising | 83/438 |
| 5,293,802 | A * | 3/1994 | Shiotani et al. | 83/468.7 |
| 5,927,857 | A | 7/1999 | Ceroll et al. | |
| 6,360,641 | B1 * | 3/2002 | Talesky et al. | 83/438 |
| 6,460,442 | B2 | 10/2002 | Talesky | |
| 7,174,820 | B2 * | 2/2007 | Huang | 83/446 |
| 2006/0070503 | A1 * | 4/2006 | Shibata et al. | 83/438 |

OTHER PUBLICATIONS

"C10RB 10" Professional Grade Portable Jobsite Table Saw with Stand, web pages from www.hitachipower tools.com, retrieved Aug. 21, 2009, 3 pages.

"Craftsman Rip Fences for Table Saws," web pages from www.old-woodworking tools.net website, retrieved Aug. 31, 2009, 6 pages.

* cited by examiner

*Primary Examiner* — Laura M. Lee
(74) *Attorney, Agent, or Firm* — Greers, Burns & Crain, Ltd.

(57) ABSTRACT

A rip fence for a table saw including a front rail and a rear rail. The rip fence includes a front clamping mechanism having a locking tip positioned adjacent to the front rail, a pivotable activation plate and a handle. A rear clamping mechanism is positioned adjacent to the rear rail, and the activation plate is coupled to the rear clamping mechanism where the handle is movable between a release position and a locking position. The activation plate includes a rolling member movable between an upper end and a lower end of the activation plate, wherein when the handle is moved from the release position to the locking position, the rolling member moves from the upper end to the lower end of the activation plate, causing the activation plate to move the rear clamping mechanism into engagement with the rear rail.

20 Claims, 6 Drawing Sheets

RIP FENCE WITH A ROLLER-TYPE ACTIVATION MECHANISM

BACKGROUND OF THE INVENTION

The present invention generally relates to rip fences for power table saws.

Table saws typically include a frame with an upper surface and a blade extending through an opening in the upper surface. The upper surface supports a work piece, such as wood, as it is pushed towards the blade for cutting. Table saws come in various sizes. There are stand-alone table saws that are commonly used in workshops, and portable table saws that are easier to move and therefore, commonly used in the field such as at construction sites. The relatively large stand-alone table saws are able to cut larger and heavier materials whereas the smaller portable table saws are used mostly for lighter materials.

Most table saws include a rip fence that extends from the front edge to the rear edge of the table saw and parallel to the blade. The rip fence is used to align and guide a piece of material during cutting. The position of the rip fence can be changed based on the type and length of a cut. To secure the rip fence in a particular position prior to cutting, rip fences include a locking or activation mechanism that locks the rip fence in a desired position to prevent it from moving during cutting. This enables accurate and straight cuts to be made.

There are different methods of securing a rip fence at a given location on the upper surface of a table saw including the use of an activation mechanism. Rip fences are generally positioned parallel to the blade to make accurate cuts. Accordingly, many rip fences use clamping mechanisms to secure both ends of the rip fence in position.

To properly align the clamping mechanisms, rip fences typically include a handle which is connected to one of the clamping mechanisms and a rod that extends between the handle and the opposing clamping mechanism. Initially, the handle is in a release position where the clamping mechanisms are not engaged with the front and rear surfaces of the table saw. This allows the rip fence to be moved and aligned as needed on the table saw. Once in place, the handle is moved from the release position to a locked position. Moving the handle to the locked position causes the clamping mechanism closest to the handle to move into a locked position along the front edge surface and cause the rod, in turn, to move the opposing clamping mechanism into a locked position along the rear edge surface of the table saw.

Existing devices for securing a rip fence in a particular position on a table saw include complex locking mechanisms with several linking parts, which makes it difficult and expensive to manufacture these devices.

SUMMARY OF THE INVENTION

Embodiments are disclosed for a rip fence for a table saw including a front rail and a rear rail, the rip fence including a front clamping mechanism positioned adjacent to the front rail and including a locking tip, a pivotable activation plate and a handle, a rear clamping mechanism positioned adjacent to the rear rail, the activation plate being coupled to the rear clamping mechanism where the handle is movable between a release position and a locking position, and including a rolling member movable between an upper end and a lower end of the activation plate, wherein when the handle is moved from the release position to the locking position, the rolling member moves from the upper end to the lower end of the activation plate, causing the activation plate to move the rear clamping mechanism into engagement with the rear rail.

DETAILED DESCRIPTION

Figure 1:
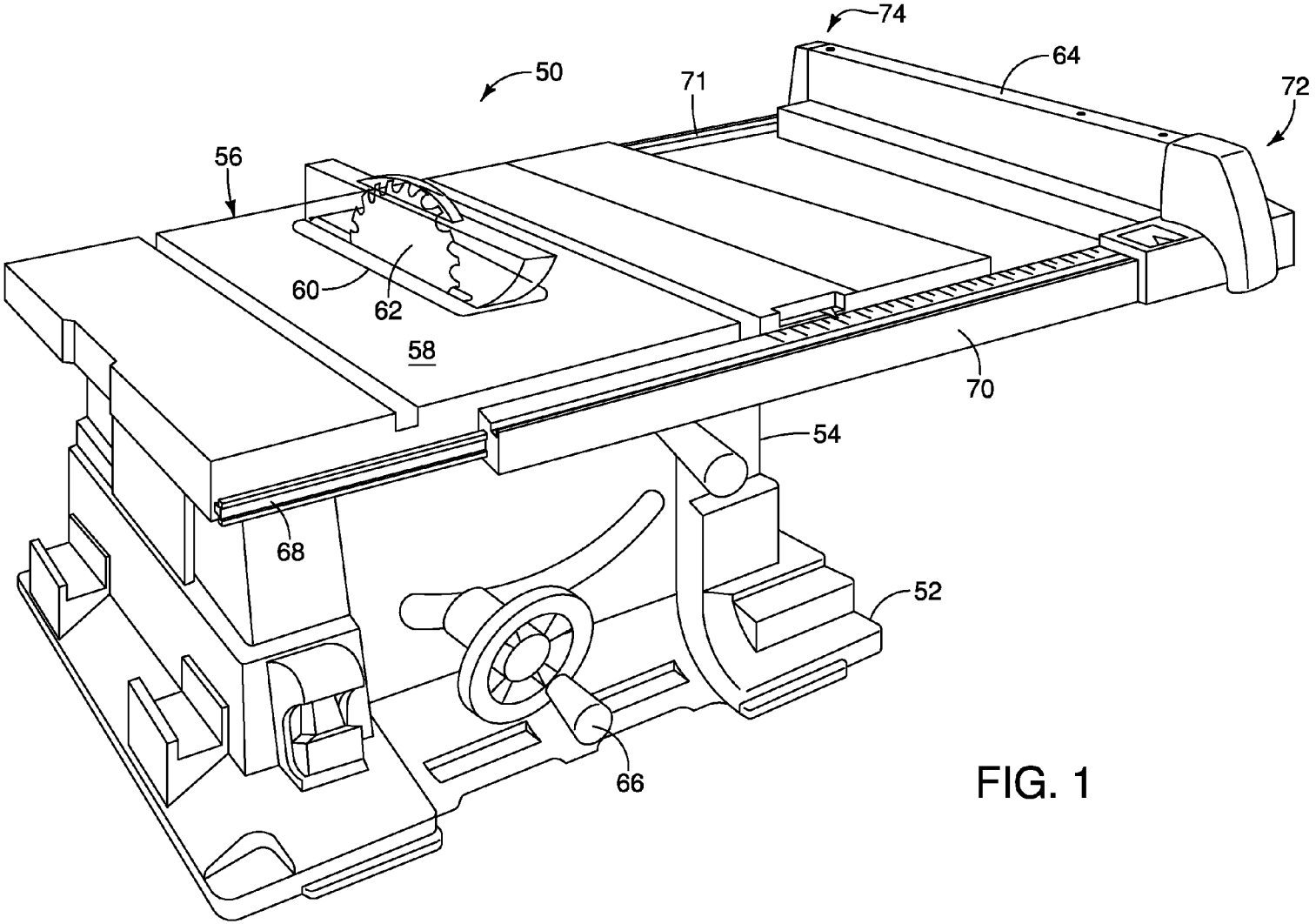
FIG. 1 is a front perspective view of a power table saw including a rip fence in an operating position in accordance with an embodiment of the present invention.
Figure 2:
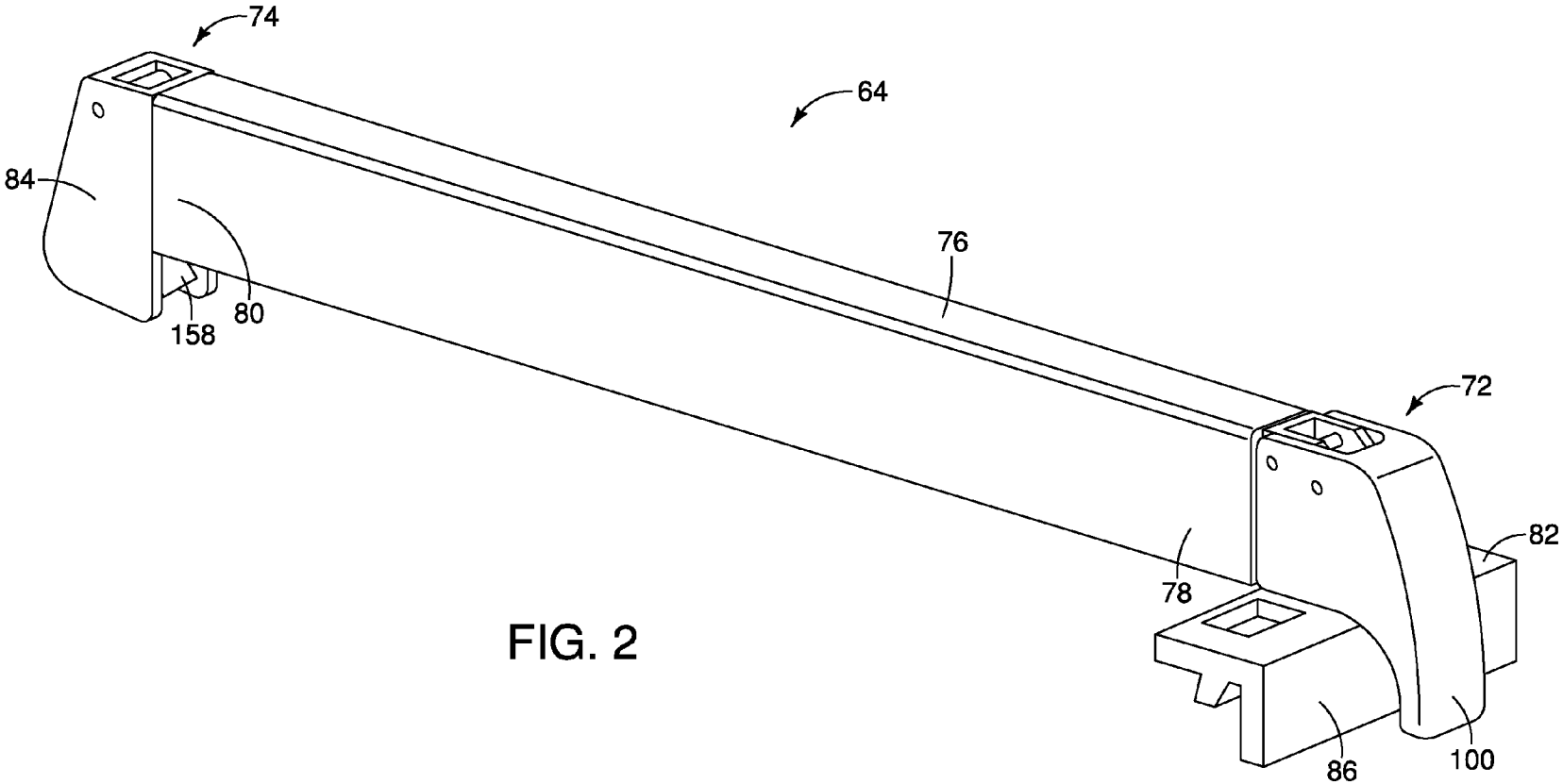
FIG. 2 is a front perspective view of the rip fence of the present invention.

The present invention is for a rip fence for a table saw including a front rail and a rear rail, where the rip fence includes a front clamping mechanism positioned adjacent to the front rail and a locking tip, a pivotable activation plate and a handle and a rear clamping mechanism positioned adjacent to the rear rail. The activation plate is coupled to the rear clamping mechanism, where the handle is movable between a release position and a locking position, and includes a rolling member movable between an upper end and a lower end of the activation plate. When the handle is moved from the release position to the locking position, the rolling member moves from the upper end to the lower end of the activation plate, causing the activation plate to move the rear clamping mechanism into engagement with the rear rail to secure the rip fence in position.

Embodiments of the present invention are shown in the drawings with a preferred embodiment being shown in FIGS. 1-6 wherein a power table saw indicated generally at 50 is illustrated and has a base 52, a frame structure 54, a table or tabletop 56 including an upper surface 58 that defines a slot 60, and a blade 62 that extends at least partially through the slot for cutting material such as wood. The saw 50 also includes a rip fence generally indicated at 64 and a bevel and blade height adjustment control indicated generally at 66.

To ensure that accurate cuts are made, it is essential that table saws include a rip fence to align and guide a piece of material during cutting. Rip fences are typically adjustable or movable along the upper surface of the table saw. As shown in FIG. 1, the rip fence 64 is secured to extendable rails 70, 71 that slide outwardly and inwardly on opposing slide members 68 to allow the tabletop 56 to be extended for larger workpieces. In FIG. 1, the rip fence 64 extends from a front edge or front rail 70 to a rear edge or rear rail 71 of the table saw 50 where the front rail and the rear rail slide along the slide members 68. Typically the rip fence 64 is oriented to be parallel to the cutting blade 62. Adjustment of the rip fence 64 occurs by sliding the front end 72 and rear end 74 of the rip fence respectively along the front and rear rails 70, 71 of the table saw. To insure that an accurate cut is made, rip fences typically include activation or locking mechanisms which secure each end of the rip fence in place on the upper surface of the table saw so that the rip fence does not move during cutting. To secure the ends in place, the present rip fence 64 includes an elongated housing or extrusion 76 having opposing ends 78, 80. A front or first clamping mechanism 82 is attached to the end 78 of the rip fence that is adjacent to the front rail 70 of the table saw 50. The opposing end 80 of the rip fence 64 includes a second or rear clamping mechanism 84 which secures an opposite end 74 of the rip fence 64 to the rear rail 71 of the table saw.

The front clamping mechanism 82 includes a front housing 86 having a generally L-shaped base portion 88 including an inwardly slanting tab or locking tip 90 that is sized to fit into a corresponding slot 92 on the front rail 70. Two spaced apart sidewalls 94 extend from an upper surface of the base 88 and are interconnected by an inner wall 96. A lateral support 98 extends transversely from the inner wall 96 and slides within and is secured to the front end or first end 78 of the extrusion 76. The front housing 86 is preferably made out of a durable metal such as zinc or aluminum but may be made out of plastic or any suitable material or combination of materials.

A handle 100 is pivotably connected to the sidewalls 94 by inserting two pivot pins 102 through holes 104 defined by the sidewalls and corresponding holes 106 defined by the handle. The handle 100 moves or pivots between a release position, where the handle is moved upwardly and away from the front housing 86, and a locked position, where the handle is moved downwardly into engagement with the front housing.

An activation plate 108 having a planar front surface 110 and an angled rear surface 112 is pivotably connected between the sidewalls 94 by a pivot pin 109 that extends through the activation plate 108 and is secured at each end to each of the sidewalls using a suitable connection method. A rod 114 extends through the extrusion 76 and interconnects the front and rear clamping mechanisms 82, 84. One end 116 of the rod 114 is connected to a lower end 118 of the activation plate 108 using a bushing or washer 120 and a lock nut 122. The front surface 110 of the activation plate 108 has a generally flat, even surface. In operation, the activation plate 108 rotates or pivots so that the lower end 118 of the activation plate moves toward or away from the extrusion 76, which causes the rod 114 to move toward or away from the rear clamping mechanism 84.

Figure 3:
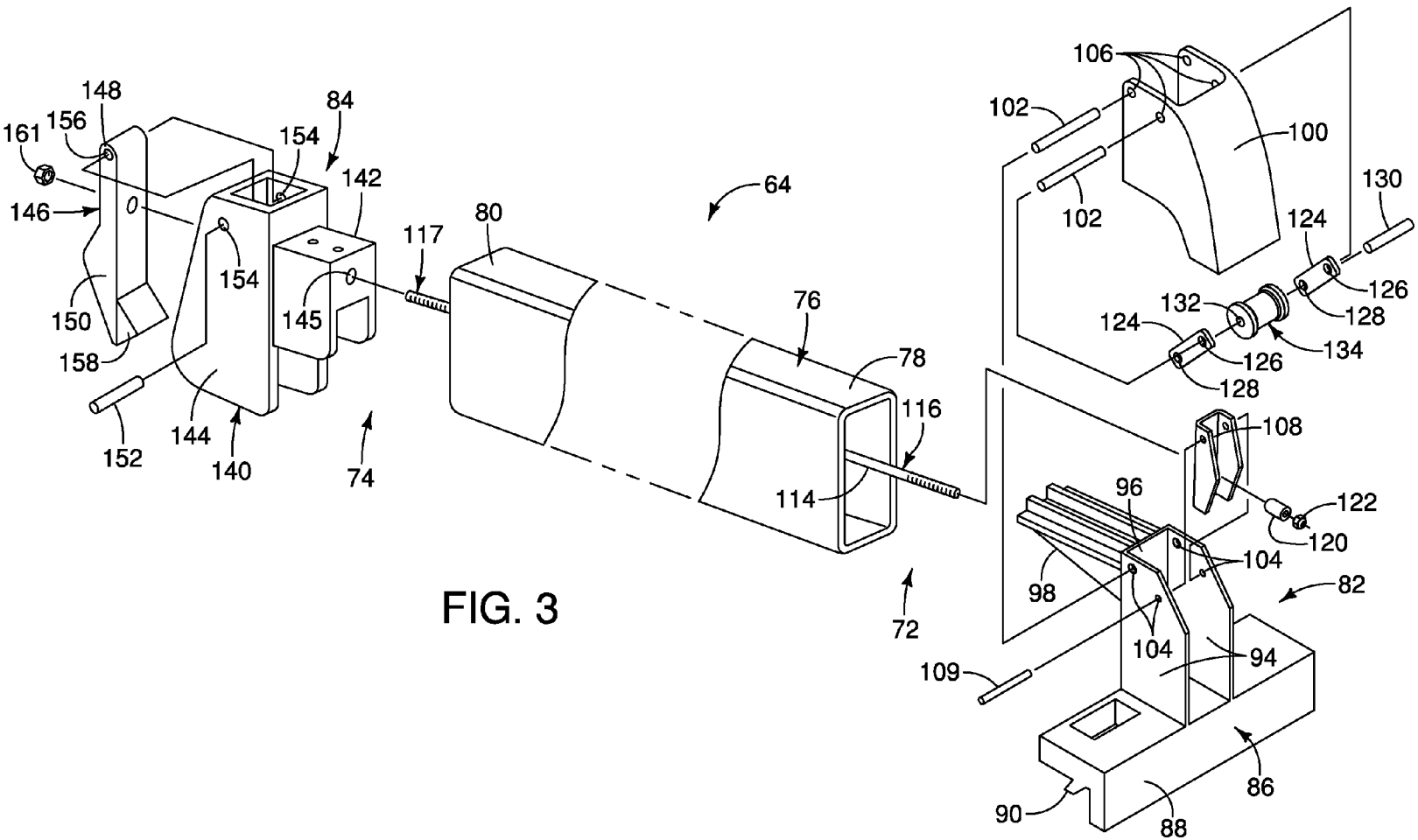
FIG. 3 is an exploded perspective view of the rip fence of FIG. 2.

Spaced apart pivot arms 124 are respectively, pivotably connected to the sidewalls of the handle 100 as shown in FIG. 3. Each of the pivot arms 124 defines two holes—an upper hole 126 and a lower hole 128. One of the pivot pins 102 extends through the sides of the handle 100 and through the upper hole 126 of the pivot arms 124. Another pivot pin 130 is inserted through the lower hole 128 of the pivot arms 124 and an extended through-hole 132 defined by a roller or rolling member 134. The ends of the pivot pin 102 are secured by press-fit or other suitable method so that the rolling member 134 and the pivot arms 124 do not move out of the holes 126, 128 defined by the pivot arms. The rolling member 134 has a generally cylindrical shape and is configured to roll along the surface of the inner wall 96 between the sidewalls 94 and the generally flat front surface 110 of the activation plate 108.

Figure 6:
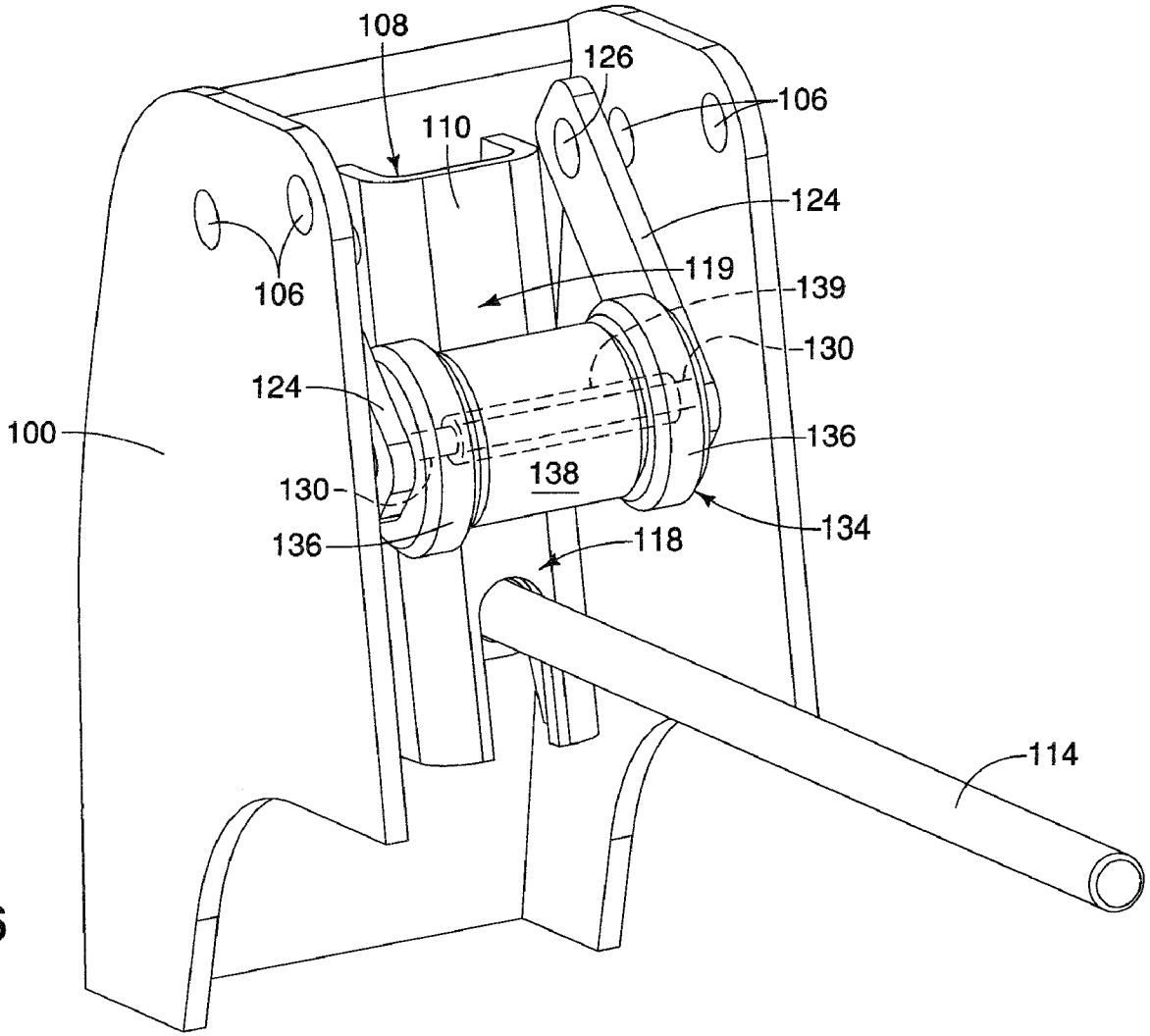
FIG. 6 is an enlarged perspective view of the front clamping mechanism of the rip fence.
Figure 7:
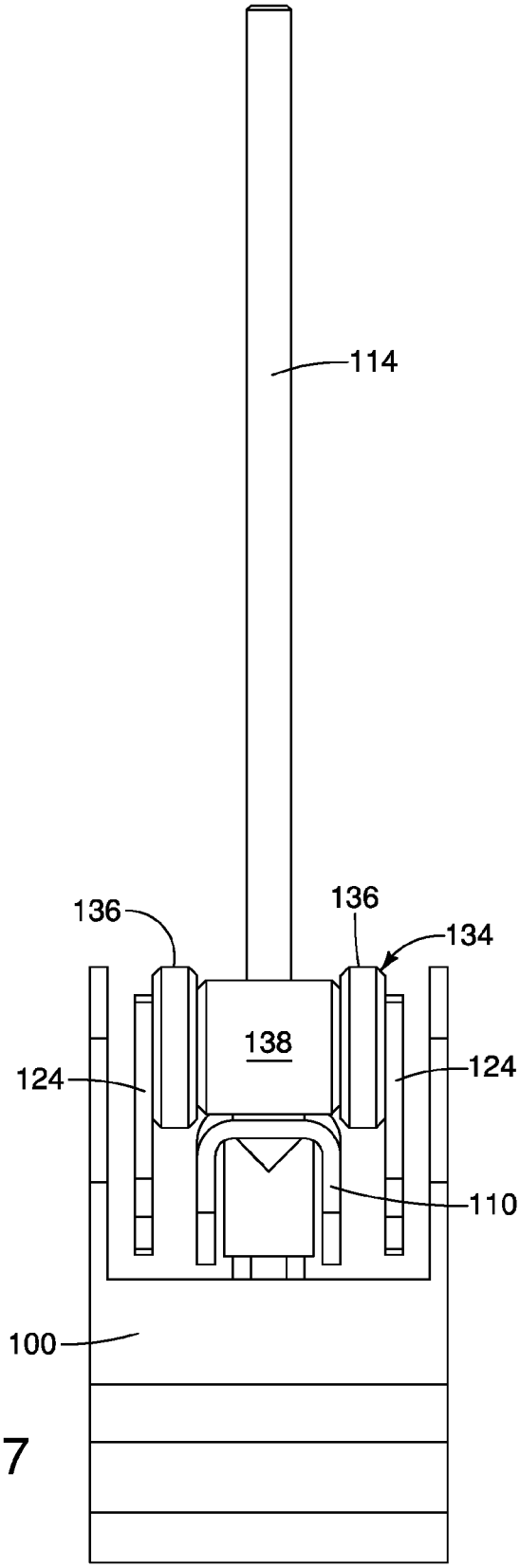
FIG. 7 is an enlarged top view of the front clamping mechanism and the rod of the rip fence.

As shown in FIGS. 3 and 6, the rolling member 134 includes a pair of outer rollers 136 that have a first diameter and an inner roller 138 that includes a second, smaller diameter. The outer rollers 136 roll along the surface of the inner wall 96 and the inner roller 138 rolls on the front surface 110 of the activation plate 108 to cause the activation plate to pivot relative to the sidewalls 94. It is contemplated that the inner wall 96 may be formed to have a neutral or negative angle relative to the front clamping mechanism 82 for better locking of the rolling member 134. The outer rollers 136 are on one axle, such as pivot pin 130, and the inner roller 138 is on a second different axle 139 where the first and second axles are concentric to each other. In this embodiment, the outer rollers 136 and inner roller 138 rotate independently of each other. It is contemplated that the outer and inner rollers may have the same or different diameters. Also the outer rollers 136 and inner roller 138 rotate independently of each other and therefore rotate in different directions relative to each other. It is further contemplated that the rolling member 134 is made of a durable material such as steel, aluminum or plastic and coated with a rubber material or other suitable non-slip material to enhance the grip of the rolling member with the inner wall 96 and the activation plate 108. Alternatively, the rolling member 134 may be made of a metal or a durable plastic or other composite material without being coated with a non-slip material such as rubber or the non-slip material may be applied to the outer rollers 136 or the inner roller 138.

Figure 4:
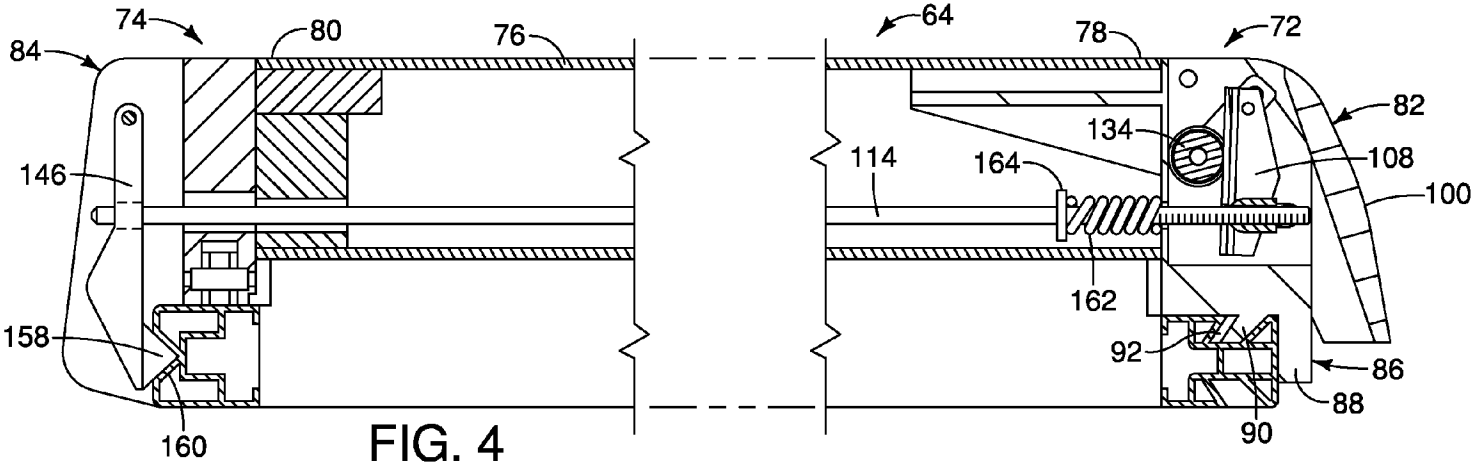
FIG. 4 is a cross-section view of the rip fence of FIG. 2 taken generally along line 4-4 in FIG. 3 illustrating the rip fence in the unlocked position.

As shown in FIG. 4, the rolling member 134 moves downwardly along the negatively inclined front surface 110 of the activation plate 108, thereby pushing the activation plate away from the extrusion 76 as the roller moves or rolls toward the bottom end 118 of the activation plate. When the rolling member 134 moves upwardly along the front surface 110 of the activation plate 108, the rolling member contacts the upper end 119 of the front surface causing the upper end 119 of the front activation plate 108 to pivot outwardly and the lower end 118 to pivot inwardly toward the extrusion 76. The moving action of the rolling member 134 is controlled by the movement of the handle 100. When the handle 100 is in the release position shown in FIG. 5, the rolling member 134 is positioned at the upper end 119 of the activation plate 108. As the handle 100 moves from the release position (FIG. 5) to a locked or activated position (FIG. 4), the rolling member 134 moves downwardly along the front surface 110 of the activation plate 108 toward the lower end 118. Thus, the position of the rolling member 134 depends on the position of the handle 100. Also, it is contemplated that the activation plate 108 may have a neutral or negative angle (i.e., slopes toward the housing) for better locking of the rolling member 134.

The second or rear clamping mechanism 84 is attached to the opposing end 80 of the extrusion 76 adjacent to the rear end or rear rail 71 of the table saw 50. The second clamping mechanism 84 includes a rear housing 140 having a front portion 142 and a rear portion 144 where the front portion defines a generally cylindrical through-hole 145 for receiving end 117 of the rod 114. The rear housing 140 may be made of metal, such as zinc or aluminum, plastic or any suitable material and is preferably integrally formed. A lever arm 146 having an upper end 148 and a lower end 150 is pivotably connected to the rear housing 140 by inserting a pivot pin 152 through holes 154 defined by opposing sides of the rear housing 140 and a hole 156 defined by the upper end 148 of the lever arm. This enables the lever arm 146 to move or pivot between a release position, where a triangular projection or locking tip 158 of the lever arm 146 is disengaged from a recess 160 on the rear rail 71, and a clamped or locked position, where the locking tip 158 is engaged with the recess. It is contemplated that the locking tip 158 may be connected to the lever arm 146 using a suitable fastener such as a screw, or it may be integrally formed with the lever arm.

Figure 5:
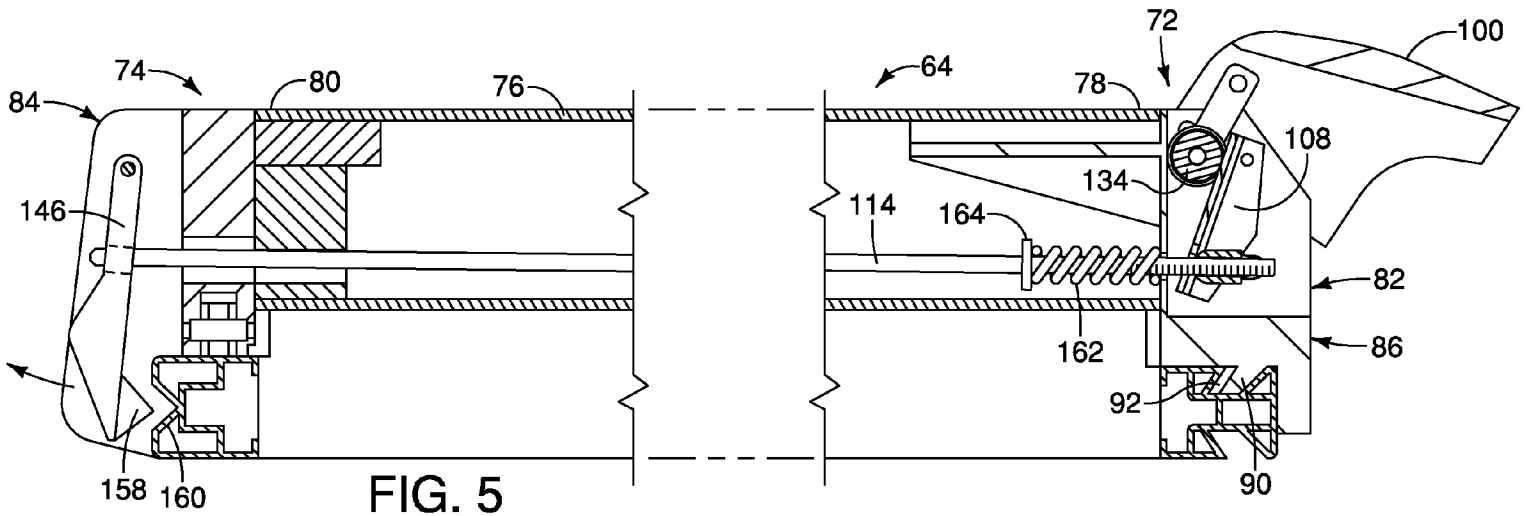
FIG. 5 is a cross-section view of the rip fence of FIG. 4 illustrating the rip fence in the locked position.

As shown in FIGS. 4 and 5, the lever arm 146 is attached to the end 117 of the rod 114 that extends through the extrusion 76 and which is opposite to the end 116 connected to the activation plate 108. Specifically, the opposing end 117 of the rod 114, which is threaded, is inserted through the transverse, cylindrical through hole 145 defined by the rear housing 140 and is connected to the lever arm 146 by a nut 161 or other suitable fastener or connection method.

A biasing member, such as a spring 162, defines a central opening having a diameter that is at least as large as the diameter of the rod 114. This enables the rod 114 to be inserted through the spring 162 as shown in FIGS. 4 and 5. The spring 162 is positioned between a stop plate 164, which is fixedly connected on the rod 114, and the inner wall 96 of the front clamping mechanism 82. The spring 162 contracts when the handle 100 is moved to the locking position as shown in FIG. 4, and expands when the handle is moved to the release position shown in FIG. 5 so as to push the rod 114 toward the rear clamping mechanism 84 to facilitate the release of the front and rear clamping mechanisms 82, 84 from the front and rear rails 70, 71 of the table saw 50. Alternatively, the spring 162 is positioned between lever arm 146 and the clamp frame support 140 so that the spring contracts when the handle 100 is moved to the locking position and expands when the handle is moved to the release position.

In operation, a user adjusts the rip fence 64 by sliding the ends 72, 74 of the rip fence along the front and rear rails 70, 71 until arriving at a desired position relative to the table saw 50. To move the rip fence 64, the handle 100 on the front clamping mechanism 82 is moved to the release position, which releases the inward clamping force of the front and rear clamping mechanisms 82, 84 on the front and rear rails 70, 71.

When the rip fence 64 is set at the desired position on the table saw 50, the user moves the handle 100 downward from the release position to the locking position. Moving the handle 100 from the release position to the locking position causes the rolling member 134 to roll downwardly along the front surface 110 of the activation plate 108. As the rolling member 134 moves downwardly, the inner roller 138 contacts the front surface 110 of the activation plate 108 while the outer rollers 136 contact the inner wall 96 between the sidewalls 94, which causes the inner roller to push inwardly on the activation plate. The inward pressure of the inner roller 138 on the front surface 110 of the activation plate 108 causes the activation plate to pivot away from the extrusion 76 as the rolling member moves toward the lower end 118 of the activation plate. The movement or pivoting of the lower end 118 of the activation plate 108 away from the extrusion 76 simultaneously pulls the rod 114 toward the front clamping mechanism 82. The movement of the rod 114 toward the front clamping mechanism 82 causes the opposing end 117 of the rod 114 to pull on the lever arm 146 of the rear clamping mechanism 84, which in turn, pulls the lower end 150 of the lever arm 146, and more specifically, the locking tip 158 on the lever arm into engagement with the recess 160 on the rear rail 71. The subsequent movement of the handle 100 to the locking position after the locking tip 158 is engaged with the recess 160 on the rear rail 71 causes the front clamping mechanism 82 to be moved inwardly so that the locking tip 90 engages the front rail 70, such as slot 92, to secure and lock the rip fence 64 in position. The rip fence 64 can now be used as a guide to align and cut a piece of material such as wood on the tabletop 56 of the table saw 50.

If the user wants to adjust the position of either of the ends 72, 74 of the rip fence 64 or move the rip fence toward or away from the blade 62, the user pulls upwardly on the handle 100 on the front clamping mechanism 82 and moves it to the release position. This action causes the rolling member 134 to move upwardly along the front surface 110 of the activation plate 108 and spring 162 causes the lower end 118 of the activation plate to pivot towards the extrusion 76. The inward movement of the lower end 118 of the activation plate 108 causes the rod 114 to move inwardly relative to the front clamping mechanism 82, which causes the spring 162 to expand and push the lever arm 146 outwardly at the opposing end 117 of the rod 114. As the lever arm 146 moves outwardly the projection or locking tip 158 disengages from the recess 160 to allow the user to slide or move the rip fence 64 along the front and rear rails 70, 71.

The present rip fence 64 has a single activation mechanism that allows a user to secure and lock the rip fence in place by simply moving the handle from a release to a locking position. Additionally, the rolling member 134 eliminates the need for complex linkages and moving parts to secure the rip fence in place, which simplifies manufacturing and reduces costs associated with making the activation mechanism and costs associated with repairing or replacing parts associated with that mechanism. Furthermore, the rolling member 134 on the handle 100 reduces friction along the front surface 110 of the activation plate 108 and facilitates the smooth, continuous movement of the rolling member along the activation plate for easier operation.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A rip fence for a table saw including a front rail and a rear rail, the rip fence comprising:

a front clamping mechanism positioned adjacent to the front rail and including a wall, a locking tip, a pivotable activation plate and a handle;

a rear clamping mechanism positioned adjacent to the rear rail;

said activation plate being coupled to said rear clamping mechanism;

said handle being movable between a release position and a locking position, and a rolling member rotatably connected to said handle and positioned between said wall and said activation plate, said rolling member configured to roll along on a surface of said wall and a surface of said activation plate between an upper end and a lower end of said activation plate, wherein when said handle is moved from the release position to the locking position, said rolling member rolls from said upper end to said lower end of said activation plate, causing said activation plate to move said rear clamping mechanism into engagement with the rear rail.

2. The rip fence as defined in claim 1 wherein said rolling member includes an axle having spaced apart outer rollers and an inner roller positioned between said outer rollers.

3. The rip fence as defined in claim 2 wherein said outer rollers each have a diameter that is greater than a diameter of said inner roller.

4. The rip fence as defined in claim 1 wherein said rolling member includes first and second concentric axles, said first axle including opposing outer rollers and said second axle including an inner roller positioned between said outer rollers.

5. The rip fence as defined in claim 1 wherein said handle includes spaced apart pivot arms, one of said pivot arms being attached to a first end of said rolling member and said other of said arms being attached to a second opposing end of said rolling member.

6. The rip fence as defined in claim 1 further comprising a rod having opposing end portions, one of said end portions connected to said lower end of said activation plate and said other of said end portions connected to said rear clamping mechanism.

7. The rip fence as defined in claim 6 further comprising a biasing member on said rod adjacent to said front clamping mechanism, said biasing member being configured to bias said rear clamping mechanism away from the rear rail.

8. The rip fence as defined in claim 1 wherein said rear clamping mechanism includes a locking tip and said activation plate moves outwardly and pulls said locking tip into engagement with the rear rail when the handle is moved from the release position to the locking position.

9. A table saw comprising:

a table having an upper cutting surface through which a blade extends to cut material, said table having a front rail with a front groove and a rear rail defining a rear groove; and a rip fence comprising:

an elongated extrusion having a first end and an opposing second end;

a front clamping mechanism attached to said first end of said extrusion, said front clamping mechanism including a wall, a front locking tip configured to engage said front groove, a handle movable between a locked position and a release position, a pivotable activation plate having an upper end and a lower end, and a rolling member positioned between said wall and said activation plate, said rolling member being rotatably connected to said handle and configured to roll along on a surface of said wall and a surface of said activation plate between said upper end when said handle is in said release position, and said lower end when said handle is in said locked position;

a rear clamping mechanism having a movable rear locking tip, wherein when said handle is in said locked position, said rear locking tip moves into engagement with said rear groove to secure the rip fence, and when said handle is in said release position, said rear locking tip moves out of engagement with said rear groove to allow the rip fence to be moved along said front and rear rails; and an elongated rod having opposing ends, one of said ends being connected to said activation plate and said other of said ends being connected to said rear clamping mechanism, wherein when said handle is moved from said release position to said locked position, said rolling member rolls from said upper end to said lower end of said activation plate causing said lower end of said activation plate to move outwardly and pull said rod, which in turn, pulls said rear locking tip into engagement with said rear groove to secure said rip fence to said table.

10. The rip fence as defined in claim 9 wherein said rolling member includes an axle having spaced apart outer rollers and an inner roller positioned between said outer rollers.

11. The rip fence as defined in claim 10 wherein said outer rollers each have a diameter that is greater than a diameter of said inner roller.

12. The rip fence as defined in claim 9 wherein said rolling member includes first and second concentric axles, said first axle including opposing outer rollers and said second axle including an inner roller positioned between said outer rollers.

13. The rip fence as defined in claim 9 wherein said handle includes spaced apart pivot arms, one of said pivot arms being attached to a first end of said rolling member and said other of said arms being attached to a second opposing end of said rolling member.

14. The rip fence as defined in claim 9 further comprising a spring on said rod adjacent to said locking tip of said front clamping mechanism, said spring configured to bias said locking tip of said rear clamping mechanism away from the rear rail.

15. A rip fence movably attached to a table saw having a frame, said rip fence comprising:

an elongated extrusion having a first end and an opposing second end;

a front clamping mechanism on said first end of said extrusion, said front clamping mechanism including a wall and a handle movable between a locked position and a release position;

a front activation plate having an upper end and a lower end, said upper end of said front activation plate being pivotably connected to said front clamping mechanism;

a rolling member positioned between said wall and said front activation plate, said rolling member being rotatably connected to said front clamping mechanism and configured to roll along on a surface of said wall and a surface of said activation plate between said upper end of said front activation plate when said handle is in said release position, and said lower end of said front activation plate when said handle is in said locked position; and a rear clamping mechanism on said second end of said extrusion, said rear clamping mechanism being coupled to said front activation plate, wherein when said handle is moved from said release position to said locked position, said rolling member rolls from said upper end of said activation plate to said lower end of said activation plate causing said lower end of said activation plate to move outwardly and move said rear clamping mechanism into engagement with the frame to secure the rip fence in position.

16. The rip fence of claim 15, further comprising an elongated rod having opposing ends, one of said ends being connected to said activation plate and said other of said ends being connected to said rear clamping mechanism, wherein when said handle is moved from said release position to said locked position, said rolling member moves from said upper end to said lower end of said activation plate causing said lower end of said activation plate to move outwardly and pull said rod, which pulls said rear clamping mechanism into engagement with the frame.

17. The rip fence of claim 15, wherein said rolling member includes an axle having opposing outer rollers and an inner roller positioned between said outer rollers, said outer rollers configured to roll along said extrusion and said inner roller configured to roll along said activation plate.

18. The rip fence of claim 17, wherein said rolling member includes a first axle and a second axle, wherein said first and second axles are concentric, said first axle including outer rollers on opposing ends of said first axle configured to roll along said housing, said second axle including an inner roller positioned between said outer rollers and configured to roll along said activation plate.

19. The rip fence as defined in claim 17, wherein a diameter of each of said outer rollers and said inner roller are the same.

20. A table saw including a rip fence, the rip fence comprising:

an extrusion having a first end and an opposing second end;

a first clamping mechanism attached to said first end and engageable with a front rail of the table saw, said clamping mechanism including a wall, a handle, a pivoting activation plate, and a roller positioned between said wall and said activation plate and rotatably connected to said handle, said handle being movable between a release position and a locked position;

a second clamping mechanism attached to said second end and engageable with a rear rail of the table saw; and a rod interconnecting said first and second clamping mechanisms, wherein when said handle is in the release position, said first and second clamping mechanisms are respectively disengaged from said front and rear rails of the table saw, and when said handle is moved to the locked position, said roller rolls downwardly along on a surface of said wall and on a surface of said activation plate causing said activation plate to pull said rod and move the first and second clamping mechanisms into engagement with said front and rear rails to secure the rip fence in position.

* * * * *